US006655550B2

(12) United States Patent
Garcia et al.

(10) Patent No.: US 6,655,550 B2
(45) Date of Patent: Dec. 2, 2003

(54) FLUID PRODUCT DISPENSER

(75) Inventors: Firmin Garcia, Evreux (FR); Alex Millian, Breteuil-sur-Iton (FR)

(73) Assignee: Valois S.A.S., Le Neubourg (FR)

( * ) Notice: Subject to any disclaimer, the term of this patent is extended or adjusted under 35 U.S.C. 154(b) by 0 days.

(21) Appl. No.: 10/193,123

(22) Filed: Jul. 12, 2002

(65) Prior Publication Data

US 2003/0024949 A1 Feb. 6, 2003

Related U.S. Application Data

(60) Provisional application No. 60/317,927, filed on Sep. 10, 2001.

(30) Foreign Application Priority Data

Jul. 19, 2001 (FR) ..... 01 09666

(51) Int. Cl.[7] ..... B65D 35/30
(52) U.S. Cl. ..... 222/103; 222/214; 222/390
(58) Field of Search ..... 222/95, 103, 214, 222/390, 386.5, 387, 327

(56) References Cited

U.S. PATENT DOCUMENTS

| | | | | | |
|---|---|---|---|---|---|
| 1,286,875 | A | * | 12/1918 | Emerson | 184/38.1 |
| 3,155,281 | A | * | 11/1964 | Stracey | 222/107 |
| 3,815,787 | A | * | 6/1974 | Spies | 222/95 |
| 5,037,010 | A | * | 8/1991 | Dikstein | 222/390 |
| 5,356,037 | A | | 10/1994 | Harrold | |

FOREIGN PATENT DOCUMENTS

| | | |
|---|---|---|
| EP | 0 869 080 | 10/1998 |

* cited by examiner

*Primary Examiner*—Gene Mancene
*Assistant Examiner*—Patrick Buechner
(74) *Attorney, Agent, or Firm*—Sughrue Mion, PLLC

(57) ABSTRACT

A fluid product dispenser having a distribution orifice and a variable volume reservoir that varies by displacement of a mobile wall in order to reduce the volume of the reservoir. The dispenser is provided with an actuation device to move the mobile wall of the reservoir. Advantageously, the actuation device is rotary and has a thread that is engaged with the reservoir.

18 Claims, 3 Drawing Sheets

FLUID PRODUCT DISPENSER

CROSS REFERENCE TO RELATED APPLICATION

This application claims the benefit under 35 U.S.C. §119 (e) of pending U.S. provisional patent application Ser. No. 60/317,927, filed Sep. 10, 2001, and priority under 35 U.S.C. §119(a)–(d) of French patent application No. FR-01.09666, filed Jul. 19, 2001.

TECHNICAL FIELD

This invention relates to a fluid product dispenser comprising a reservoir with a volume that can be varied by displacement of a mobile wall in order to reduce the volume of the reservoir and a distribution orifice. The mobile wall may be moved either by means of a deformation or a sealed slide. In the first case, the reservoir or at least part of the reservoir is deformed, which is why a deformable and/or elastic flexible material is used, and in the second case piston-follower systems are used in which a piston moves inside a cylindrical barrel in order to gradually reduce the useful volume of the reservoir. In both cases, the volume of the reservoir reduces as the fluid product is extracted from it. The fluid product is thus never in contact with air inside the reservoir, which improves conservation of the product, particularly when it is sensitive to oxidation or deterioration in contact with air.

BACKGROUND OF THE INVENTION

Examples of dispensers with a deformable reservoir include dispensers in which the deformation is made by manual compression, that are called "squeeze bottles". The user's hand compresses the reservoir directly. On the other hand in piston-follower systems, the piston-follower rises in the receptacle either automatically under the effect of the negative pressure created in the receptacle when the dispenser is activated, or by means of a spring that pushes the piston so that the internal volume of the receptacle is reduced.

The purpose of this invention is to overcome the above mentioned disadvantages with prior art by proposing a dispenser provided with actuation means that act on the mobile wall of the dispenser.

The European application EP-0 869 080 describes a dispenser comprising an helical bellows. The outer wall of the bellows forming the helical thread engages a rotative skirt provided with an inner annular rib. So, the free rotation of the skirt causes the helical threads to be progressively gathered in the manner of an accordion.

The single annular rib of the skirt is located at the top of the bellows, so that the rib initially engages the uppermost thread of the bellows and engages progressively the below threads as the skirt is rotated. The threads of the bellows have to be both flexible to allow the gathering of the bellows and rigid to permit the threaded engagement with the annular rib of the skirt. However, the bottom of the bellows is free and has therefore to be also rigid. Such a bellows is not easy to manufacture, since it has to be both flexible and rigid.

The present invention overcomes all these drawbacks in defining a simpler dispenser.

In this purpose, actuation means are rotary and comprise a thread that is engaged with the reservoir. Several distinct threads may be provided. Advantageously, the reservoir comprises one or several displacement flanges fixed to the mobile wall and that engage in the thread. Thus, by rotation of the actuation means, the mobile wall moves in translation and tends to reduce the useful volume of the reservoir. It is to be noticed that the actuation means directly acts on the bottom of the reservoir, whereas in the previously commented European application, the bottom of the reservoir is pulled and not pushed.

According to one embodiment, the dispenser comprises a body, the rotating actuation means being fitted free to rotate in the said body without making any translation displacement with respect to the said body. The actuation means thus turn freely in the body forcing the mobile wall upwards to reduce the volume of the reservoir. Advantageously, the body forms a part of the reservoir.

According to one characteristic of the invention, the reservoir comprises bellows in a leak tight contact with the body, the said bellows forming the mobile wall. Advantageously, the bellows comprises a leak tight attachment collar connected with a connection sleeve formed by the body. Thus, the bellows is fixed firstly to the body and secondly is engaged by threading with actuation means. According to one practical embodiment, the mobile wall is connected to the attachment collar through a deformable wall. The distribution orifice may also be formed in the body.

According to another aspect of the invention, the actuation means form a bottom for the dispenser.

According to another characteristic, the actuation means comprise a peripheral gripping device capable of moving the actuation means in free rotation in the body. Thus, the body can be held in place with one hand and the actuation means can be rotated with the other hand.

BRIEF DESCRIPTION OF THE DRAWINGS

The invention will now be described in more detail with reference to the attached drawing showing one embodiment of the invention as a non-limitative example.

In the figures.

DETAILED DESCRIPTION

The fluid product dispenser according to the invention comprises essentially three components, namely a bellows 1, actuation means 2 and a body or casing 3.

The bellows 1 is a single piece part, for example made from a deformable flexible material such as an elastomer or an elastomer thermoplastic. It has good deformability properties in specific areas. The bellows 1 comprises a bottom wall 11 that is almost rigid. This bottom wall 11 may be perfectly plane, but it may also be convex as shown in FIG. 3.

Figure 1:
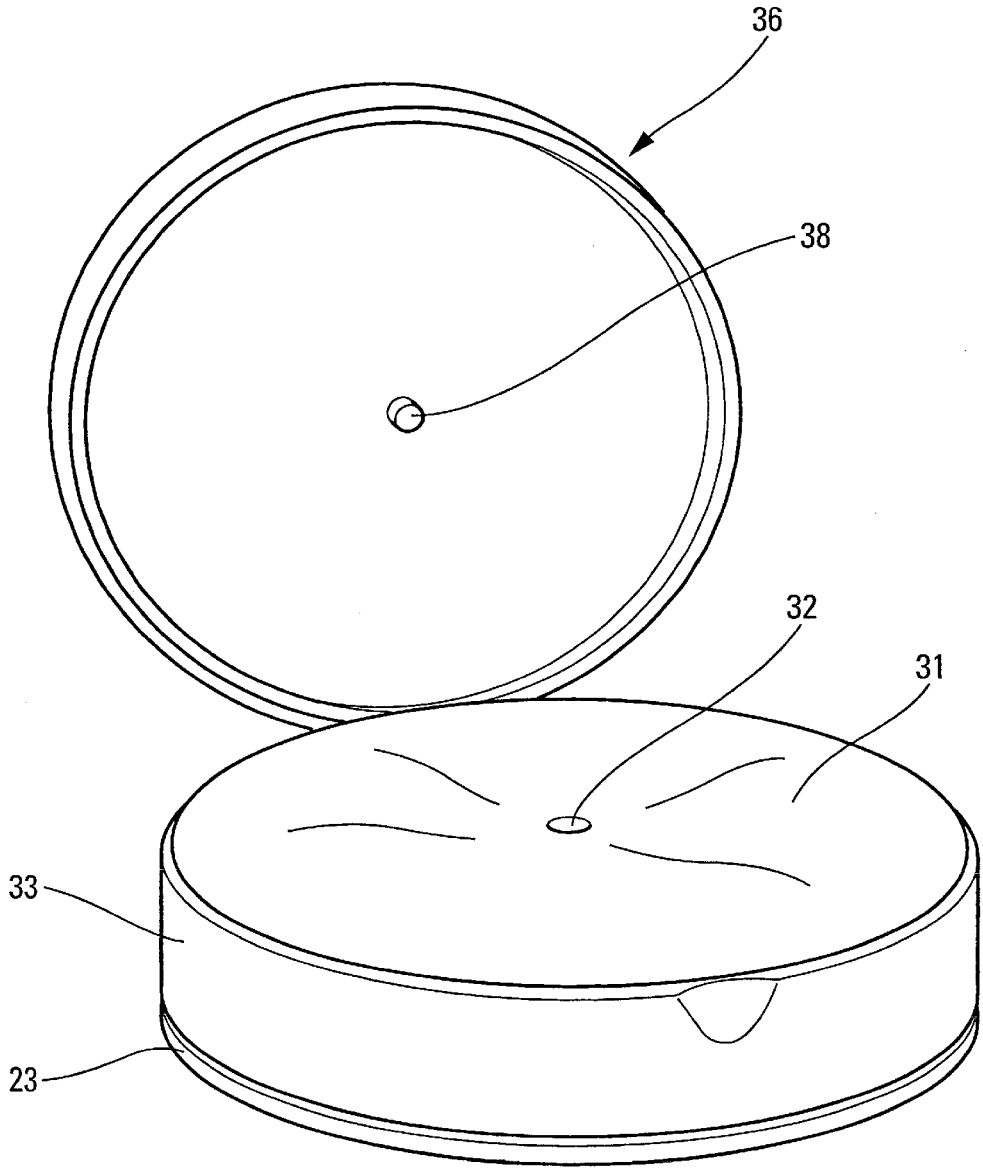
FIG. 1 is a perspective diagrammatic view of a dispenser according to the invention.
Figure 2:
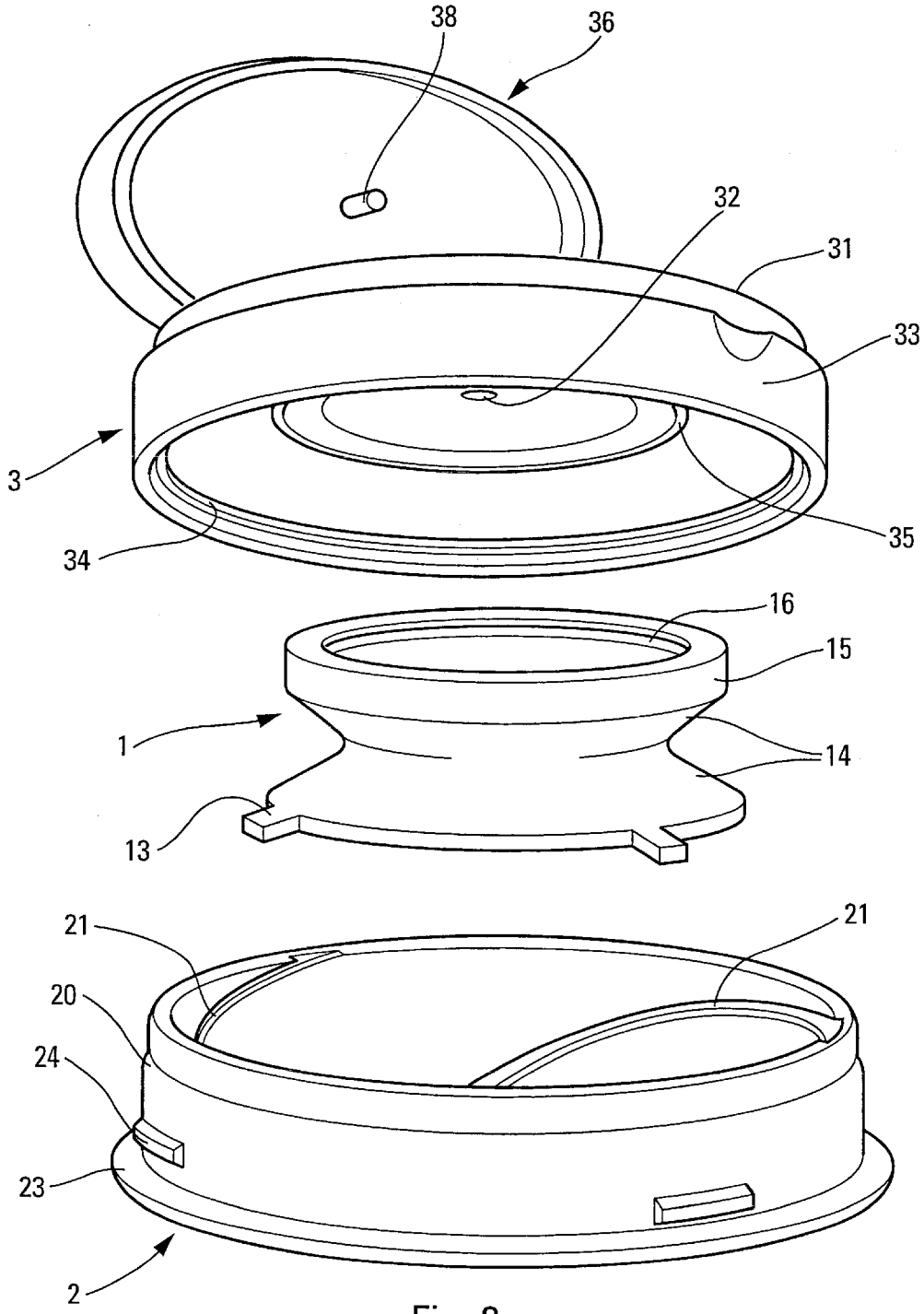
FIG. 2 is an exploded perspective view of the dispenser in FIG. 1.
Figure 3:
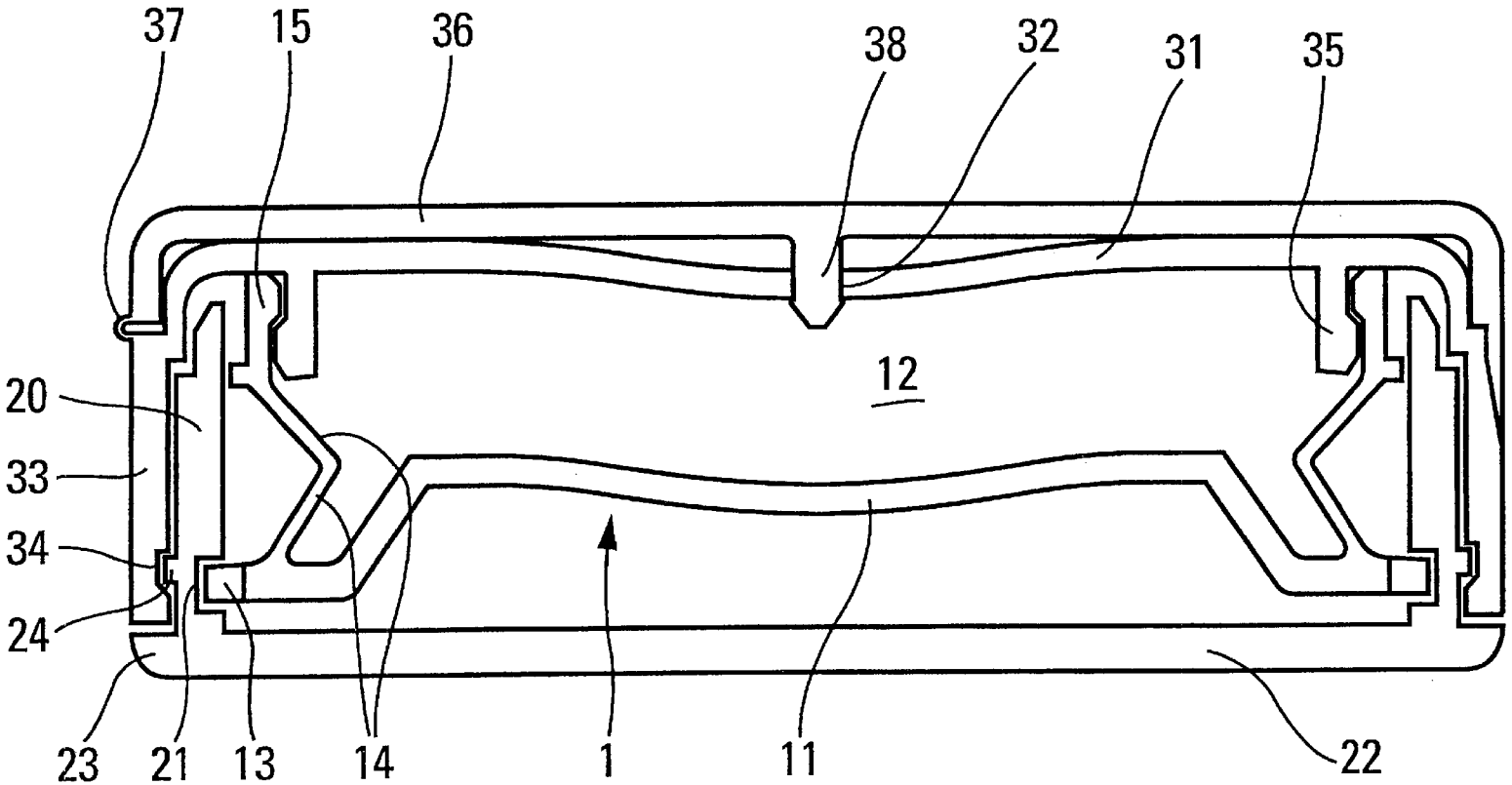
FIG. 3 is a cross-sectional view through the dispenser in FIGS. 1 and 2.

FIG. 3 shows that the bottom wall 11 forms a sort of dome or inverted dish that projects upwards. The bottom wall 11 around its external periphery defines at least one displacement flange 13 that is almost rigid. The figures show three flanges 13.

Bellows 1 also forms an attachment collar 15 that is also almost rigid. For example, this attachment collar 15 may define a leak tight click fit housing 16 that will cooperate with a complementary device as can be seen below. The bellows 1 also comprises a deformable wall 14 that connects the attachment collar 15 to the bottom wall 11. For example, the wall 14 may be made deformable by the wall being thinner than the bottom wall 11 or the attachment collar 15. Thus, the wall 11 can be moved closer to the attachment collar 15 in translation by deformation of the wall 14. More precisely, it can be seen in figures that the deformable wall 14 forms a fold that will be accentuated if pressure is exerted tending to bring the collar 15 closer to the flanges 13. This deformable wall 14 is the wall that justifies the name of the part, since this is the part that performs the bellows function. Obviously, other means of making a deformable part could be imagined. For example, the bellows 1 could be replaced by a flexible pouch fixed on a pouch support performing the function of the attachment collar 15. The bottom wall 11 may be replaced by a plate on which the flexible pouch is supported. The displacement flanges 13 may be formed by the periphery of the plate supporting the flexible pouch. Other embodiments, such as a piston-follower that can be moved in a sliding cylinder, could also be imagined.

In the embodiment shown in figures, the actuation means 2 comprise a bushing threaded on the inside 20 to form one or several internal threads 21. As can be seen in FIG. 3, the displacement flanges 13 of the bellows are engaged by threading with these internal threads 21. Below the threaded bushing 20, the actuation means define an actuation and gripping element 23 that the user can grip to rotate the actuation means. Optionally, the actuation means 2 form a bottom 22 that will advantageously act as a bottom for the dispenser. A continuous strip or several segments of projecting strip 24 will be formed on the outer wall of the threaded bushing 20, extending over some or all of the periphery of the bushing 20. It is easy to see that rotation of the actuation means 2, while the bellows 1 is fixed, will cause displacement on the flanges 13 inside the threaded bushing 20.

The body 3 of the dispenser forms a sort of outer casing that contributes largely to the aesthetic appearance of the dispenser. The body 3 comprises a peripheral skirt 33 inside which the bushing 20 of the actuation means 2 are arranged. In the embodiment shown in figures, the skirt 33 is formed on the inside with an annular housing 34 which contains the segments of the projecting strip 24 formed on the outside of the threaded bushing 20. The segments of the strip 24 are engaged in the housing 34 to prevent the bushing 20 from rotating in the skirt 33. Thus, actuation means 2 can rotate freely within the skirt 33 but cannot come free of it. Rotation takes place freely, since the segments of the strip 24 and the housing 34 are perfectly circular and are not spiral.

Above the skirt 33, the body 3 forms a tray 31 in which a hole is formed that acts as the distribution orifice 32 for the dispenser. A connection sleeve 35 extends under the tray 31 around the distribution orifice 32. This connection sleeve has an attachment profile that engages with the leak tight attachment collar 15 of the bellows 1. Thus, the bellows 1 is fixed to the body 3, and is not free to rotate independently of it. Consequently, the assembly consisting of the bellows 1 and the body 3 form a reservoir 12 with a variable volume, given that the mobile wall 11 can move in the direction of the tray 31 by deformation of the wall 14. This is exactly what happens when the actuation means 2 are rotated while keeping the body 3 motionless. For example, the user can grip the body 3 with his left hand and use his right hand to rotate the actuation means 2, gripping them at the actuation and gripping element 23. The effect is to lift the displacement flanges 13 in the internal threads of the bushing 20. The mobile wall 11 then moves up towards the tray 31 to reduce the useful volume of the reservoir 12. The fluid product stored inside the reservoir 12 is then forced through the distribution orifice 32 so that the user can collect it on the tray 31.

In this case, the reservoir 12 is formed by assembling the bellows 1 and the body 3. However, it would be possible to imagine other embodiments in which the reservoir 12 is formed from a single piece, for example a flexible pouch in which the opening defines the distribution orifice 32. In this case, the tray 31 will only act as a contact surface and a reception surface to recover the fluid product.

Optionally, the body 3 may be formed with a cover 36 that is connected in a single piece through a material bridge 37 to the rest of the body 3. This material bridge 37 thus forms a pivoting hinge by which the cover 36 can be pivoted with respect to the skirt 33 and the tray 31. The lower face of the cover 36 defines a suitably shaped closing needle 38 that fits into the distribution orifice 32 in a sealed manner to hermetically close it. This is the case when the cover 36 is folded over onto the plate 31.

With the dispenser according to the invention, it is possible to obtain a dose of fluid product with a volume that is directly proportional to the rotation of the actuation means.

What is claimed is:

1. Fluid product dispenser comprising:

a variable volume reservoir (12) comprising a deformable wall (14) and a mobile wall (11), the mobile wall being movable in order to reduce the volume of the reservoir by deformation of the deformable wall, a distribution orifice (32), and actuation means (2) to move the mobile wall (11) of the reservoir, wherein the actuation means rotate and comprise a thread (21) engaged with the mobile wall of the reservoir.

2. Dispenser according to claim 1, in which the reservoir (12) comprises at least one displacement flange (13) fixed to the mobile wall (11) and is engaged by threading (21).

3. Dispenser according to claim 1, in which the actuation means (2) form a bottom (22) for the dispenser.

4. Dispenser according to claim 1, in which the actuation means (2) comprise a peripheral gripping device (23) capable of driving the actuation means in free rotation in the body.

5. The dispenser according to claim 1, in which the deformable wall forms a fold tending to accentuate when the mobile wall is displaced toward the distribution orifice.

6. Dispenser according to claim 1, comprising a body (3), the rotating actuation means (2) being fixed free to rotate in the said body (3) without any translation movement with respect to the said body.

7. Dispenser according to claim 6, in which the distribution orifice (31) is formed in the body (3).

8. Dispenser according to claim 6, in which the body (3) forms a part (31) of the reservoir (12).

9. Dispenser according to claim 8, in which the reservoir (12) comprises a bellows (1) with a sealed connection with the body (3), the said bellows (1) forming the mobile wall (11).

10. The dispenser according to claim 9, in which the bellows is a single piece part forming the deformable wall and the mobile wall with its at least one flange.

11. Dispenser according to claim 9, in which the bellows (1) comprises a sealed attachment collar (15) engaged with a connection sleeve (35) formed by the body (3).

12. Dispenser according to claim 11, in which the mobile wall (11) is connected to the attachment collar (15) through the deformable wall (14).

13. Fluid product dispenser comprising:

a variable volume reservoir (12) comprising a deformable wall (14) and a mobile wall (11), the mobile wall being movable in order to reduce the volume of the reservoir by deformation of the deformable wall;

a distribution orifice (32); and an actuating cylinder having an internal thread coupled to the mobile wall (11) of the reservoir, wherein the actuating cylinder is rotatable so as to move the mobile wall in an axial direction of the thread.

14. The dispenser according to claim 13, comprising a body (3), the actuating cylinder being fixed free to rotate in the said body (3) without any axial translation movement with respect to the said body.

15. The dispenser according to claim 14, in which the body (3) forms a part (31) of the reservoir (12).

16. The dispenser according to claim 15, in which the reservoir (12) comprises a bellows (1) with a sealed connection with the body (3), the said bellows (1) forming the mobile wall (11).

17. The dispenser according to claim 16, in which the bellows (1) comprises a sealed attachment collar (15) engaged with a connection sleeve (35) formed by the body (3).

18. The dispenser according to claim 17, in which the mobile wall (11) is connected to the attachment collar (15) through the deformable wall (14).

* * * * *